US009885208B1

(12) United States Patent
Chen

(10) Patent No.: US 9,885,208 B1
(45) Date of Patent: Feb. 6, 2018

(54) WINDOW COVERING AUXILIARY DEVICE

(71) Applicant: My Home Global Company, ErShui Township, ChangHua County (TW)

(72) Inventor: Ju-Huai Chen, ErShui Township (TW)

(73) Assignee: My Home Global Company, Ershui Township, Changhua County (TW)

( * ) Notice: Subject to any disclaimer, the term of this patent is extended or adjusted under 35 U.S.C. 154(b) by 0 days.

(21) Appl. No.: 15/638,459

(22) Filed: Jun. 30, 2017

(51) Int. Cl.

| | |
|---|---|
| ***E06B 9/30*** | (2006.01) |
| ***E06B 3/28*** | (2006.01) |
| ***E06B 3/26*** | (2006.01) |
| ***E06B 9/04*** | (2006.01) |
| ***E06B 9/24*** | (2006.01) |
| *E06B 3/00* | (2006.01) |
| *E06B 9/00* | (2006.01) |

(52) U.S. Cl.
CPC ..... *E06B 3/285* (2013.01); *E06B 3/26* (2013.01); *E06B 9/04* (2013.01); *E06B 9/24* (2013.01); *E06B 3/00* (2013.01); *E06B 9/00* (2013.01)

(58) Field of Classification Search
CPC . E06B 3/285; E06B 3/26; E06B 9/262; E06B 2009/3222; E06B 9/04; E06B 9/24; E06B 3/00; E06B 9/00
USPC ..... 160/178.2, 178.1 R, 384, 379.1
See application file for complete search history.

(56) References Cited

U.S. PATENT DOCUMENTS

| | | | | | |
|---|---|---|---|---|---|
| 2,211,982 | A * | 8/1940 | O'Malley | E06B 9/78 | 160/384 |
| 2,280,969 | A * | 4/1942 | O'Malley | E06B 9/78 | 160/384 |
| 2,537,828 | A * | 1/1951 | Hoffman | E06B 9/78 | 160/384 |
| 4,088,173 | A * | 5/1978 | Antich | E06B 9/325 | 160/178.1 R |
| 5,092,387 | A * | 3/1992 | King | E06B 9/303 | 160/176.1 R |
| 5,749,406 | A * | 5/1998 | Benthin | E06B 9/364 | 160/176.1 V |
| 6,431,248 | B1 * | 8/2002 | Hyman | E06B 9/32 | 160/178.1 R |
| 7,302,738 | B2 * | 12/2007 | Nien | E06B 9/326 | 160/178.1 R |
| 7,325,279 | B2 * | 2/2008 | Huang | E06B 9/326 | 160/178.1 R |
| 7,793,701 | B2 * | 9/2010 | Liang | E06B 9/322 | 16/422 |
| 8,387,676 | B2 * | 3/2013 | Hunckler | B60J 11/08 | 160/105 |
| 8,851,148 | B2 * | 10/2014 | Lin | E06B 9/40 | 160/168.1 R |

(Continued)

*Primary Examiner* — Beth A Stephan
(74) *Attorney, Agent, or Firm* — Alan D. Kamrath; Kamrath IP Lawfirm, P.A.

(57) ABSTRACT

A window covering auxiliary device includes at least one attracted member, an operation handle and at least one attracting member. The at least one attracted member is mounted on a window covering. The operation handle includes a holding unit and a guiding unit. The guiding unit is mounted on the holding unit and has a top provided with a guide portion which is provided with a receiving recess. The at least one attracting member is mounted in the receiving recess of the operation handle. The at least one attracting member and the at least one attracted member are magnetically attracted with each other.

10 Claims, 14 Drawing Sheets

(56) References Cited

U.S. PATENT DOCUMENTS

| | | | | |
|---|---|---|---|---|
| 2005/0087312 | A1* | 4/2005 | Nien | E06B 9/326<br>160/178.1 R |
| 2007/0084567 | A1* | 4/2007 | Chen | E06B 9/32<br>160/84.05 |
| 2015/0034262 | A1* | 2/2015 | Franssen | E06B 9/388<br>160/349.1 |
| 2016/0312527 | A1* | 10/2016 | Chen | E06B 9/262 |

* cited by examiner

WINDOW COVERING AUXILIARY DEVICE

BACKGROUND OF THE INVENTION

1. Field of the Invention

The present invention relates to a window covering and, more particularly, to an auxiliary device for a window covering.

2. Description of the Related Art

A conventional magnetically attractive shade comprises a shade cloth, at least one magnetic unit mounted on the shade cloth, and at least one metal unit mounted on the shade cloth and spaced from the at least one magnetic unit. The at least one metal unit and the at least one magnetic unit are magnetically attracted with each other so as to fold the shade cloth. However, when the conventional magnetically attractive shade is located at a higher position, the user cannot easily adjust the shade cloth to the required position by restriction of the user's height and age, thereby causing inconvenience to the user when wishing to expand or fold the shade cloth.

BRIEF SUMMARY OF THE INVENTION

In accordance with the present invention, there is provided a window covering auxiliary device comprising at least one attracted member, an operation handle and at least one attracting member. The at least one attracted member is mounted on a window covering. The operation handle includes a holding unit and a guiding unit. The guiding unit is mounted on a top of the holding unit and has a top provided with a guide portion. The guide portion has a substantially L-shaped profile and defines a horizontal section and a vertical section. The guide portion has an arcuate face formed between the horizontal section and the vertical section. The horizontal section has a top provided with a receiving recess. The at least one attracting member is mounted in the receiving recess of the operation handle. The at least one attracting member and the at least one attracted member are magnetically attracted with each other.

According to the primary advantage of the present invention, the user directly operates the operation handle to lift or lower the shading member of the window covering, so that the user can easily adjust the shading member of the window covering to the required position, without restriction of the user's height and age.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
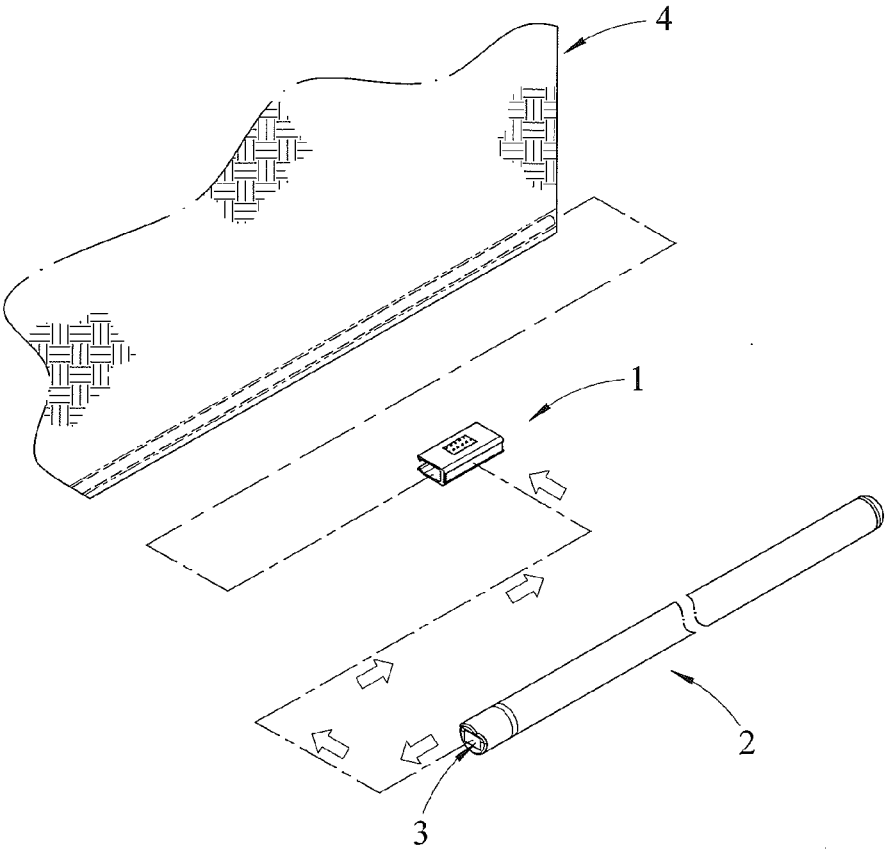
FIG. 1 is a schematic exploded perspective view of a window covering auxiliary device in accordance with the preferred embodiment of the present invention.
Figure 2:
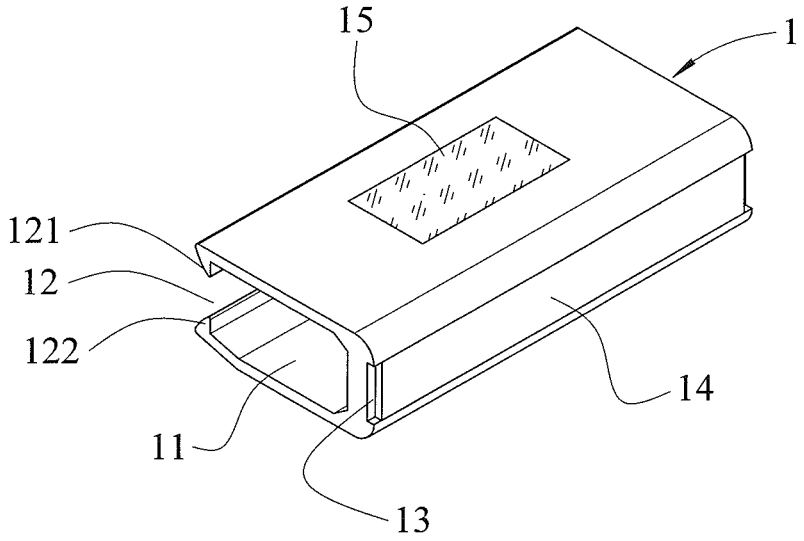
FIG. 2 is a perspective view of an attracted member of the window covering auxiliary device in accordance with the preferred embodiment of the present invention.
Figure 3:
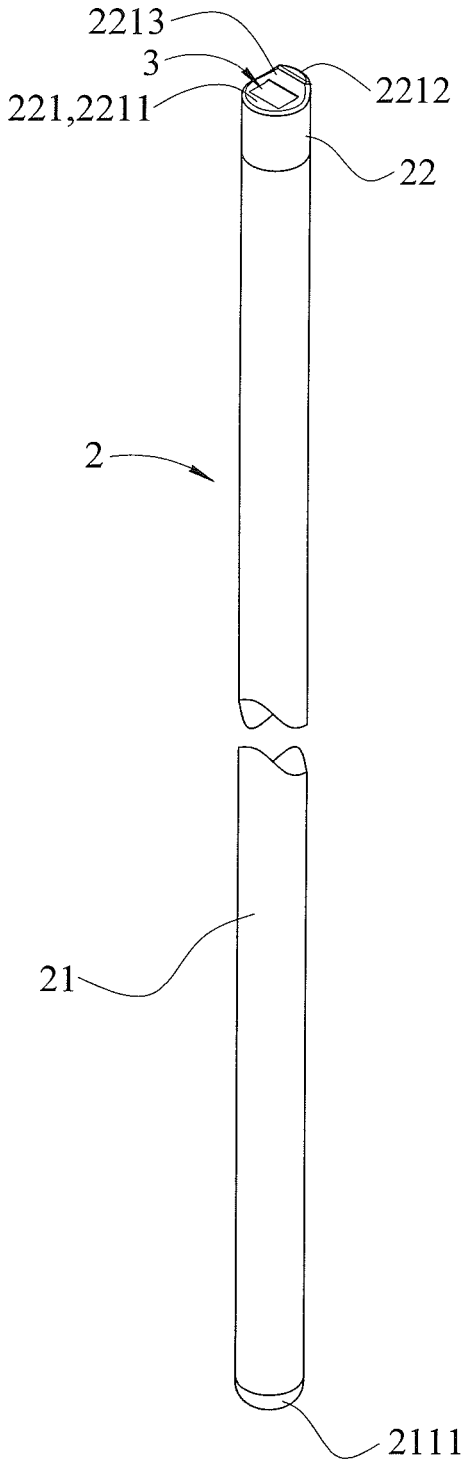
FIG. 3 is a perspective assembly view of an operation handle and an attracting member of the window covering auxiliary device in accordance with the preferred embodiment of the present invention.

Referring to the drawings and initially to FIGS. 1-6, a window covering auxiliary device in accordance with the preferred embodiment of the present invention comprises at least one attracted member 1, an operation handle 2 and at least one attracting member 3.

The at least one attracted member 1 is preferably made of metallic material and is mounted on a window covering 4. The at least one attracted member 1 has a shape corresponding to that of the window covering 4.

The operation handle 2 includes a holding unit 21 and a guiding unit 22. The holding unit 21 is made of metal, wood or plastics and has a bottom provided with an opening 211. Preferably, a plug 2111 is inserted into the opening 211 of the operation handle 2. The guiding unit 22 is mounted on a top of the holding unit 21 and has a top provided with a guide portion 221. The guide portion 221 has a substantially L-shaped profile and defines a horizontal section 2211 and a vertical section 2212. The guide portion 221 has an arcuate face 2213 formed between the horizontal section 2211 and the vertical section 2212. The horizontal section 2211 has a top provided with a receiving recess 2214.

The at least one attracting member 3 is preferably a magnet or an iron block and is mounted in the receiving recess 2214 of the operation handle 2. The at least one attracting member 3 has a shape corresponding to that of the receiving recess 2214 of the operation handle 2. Preferably, the at least one attracting member 3 is secured in the receiving recess 2214 of the operation handle 2 by glue. The at least one attracting member 3 and the at least one attracted member 1 are magnetically attracted with each other, so that the operation handle 2 is operated to move the window covering 4 so as to fold or expand the window covering 4.

In the preferred embodiment of the present invention, the at least one attracted member 1 has a substantially U-shaped profile and defines a receiving chamber 11 and a clamping slit 12. The clamping slit 12 of the at least one attracted member 1 is provided with a top hook 121 and a bottom hook 122, and the window covering 4 is clamped by the top hook 121 and the bottom hook 122 of the at least one attracted member 1. The at least one attracted member 1 has a face provided with a channel 13. A magnetic member 14 is mounted in the channel 13 of the at least one attracted member 1. The magnetic member 14 of the at least one attracted member 1 and the at least one attracting member 3 are magnetically attracted with each other. A marking zone 15 is mounted on the at least one attracted member 1. Preferably, the marking zone 15 is a character, figure, pattern or trademark.

Figure 4:
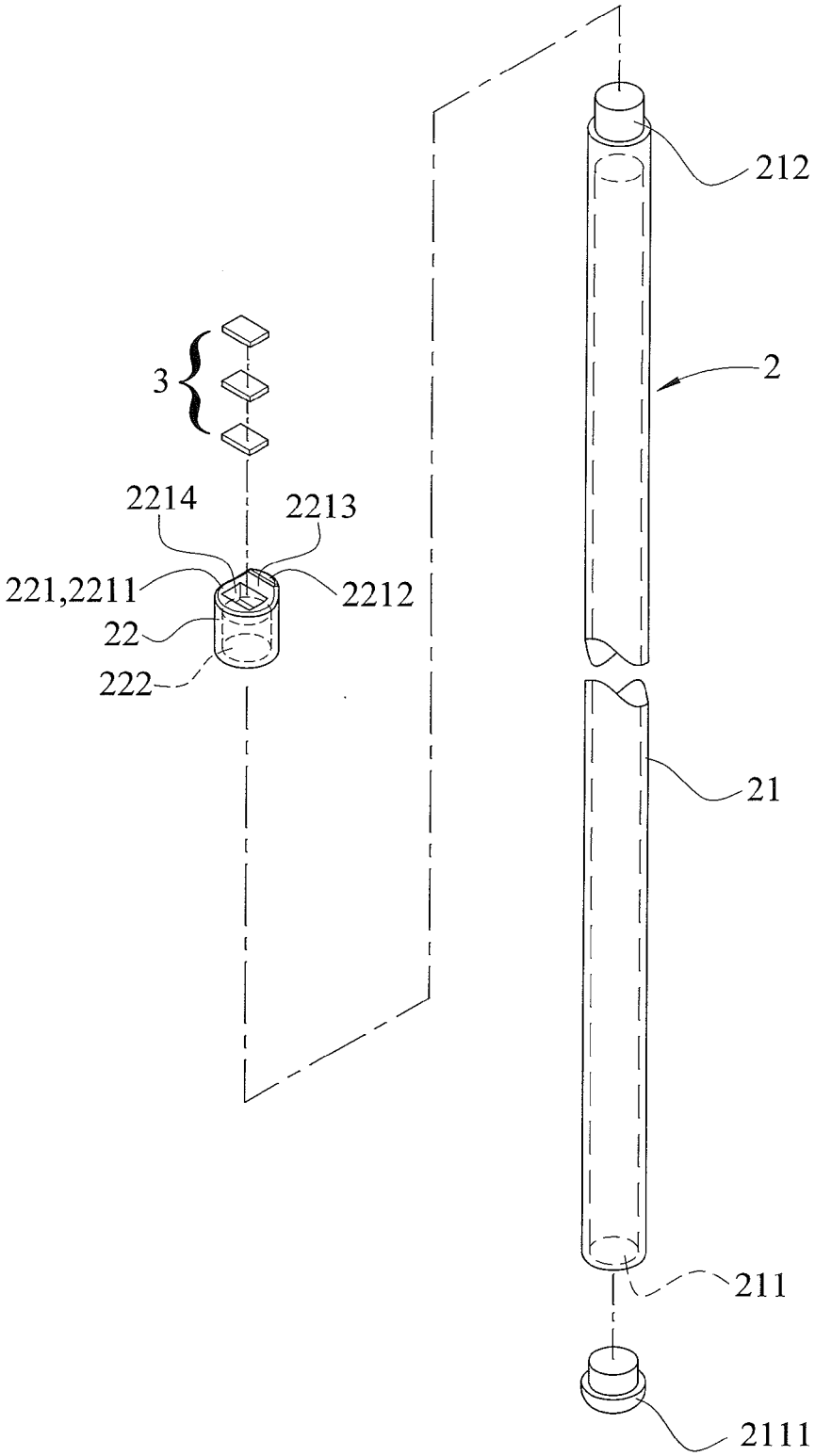
FIG. 4 is an exploded perspective view of the operation handle and the attracting member of the window covering auxiliary device as shown in FIG. 3.
Figure 5:
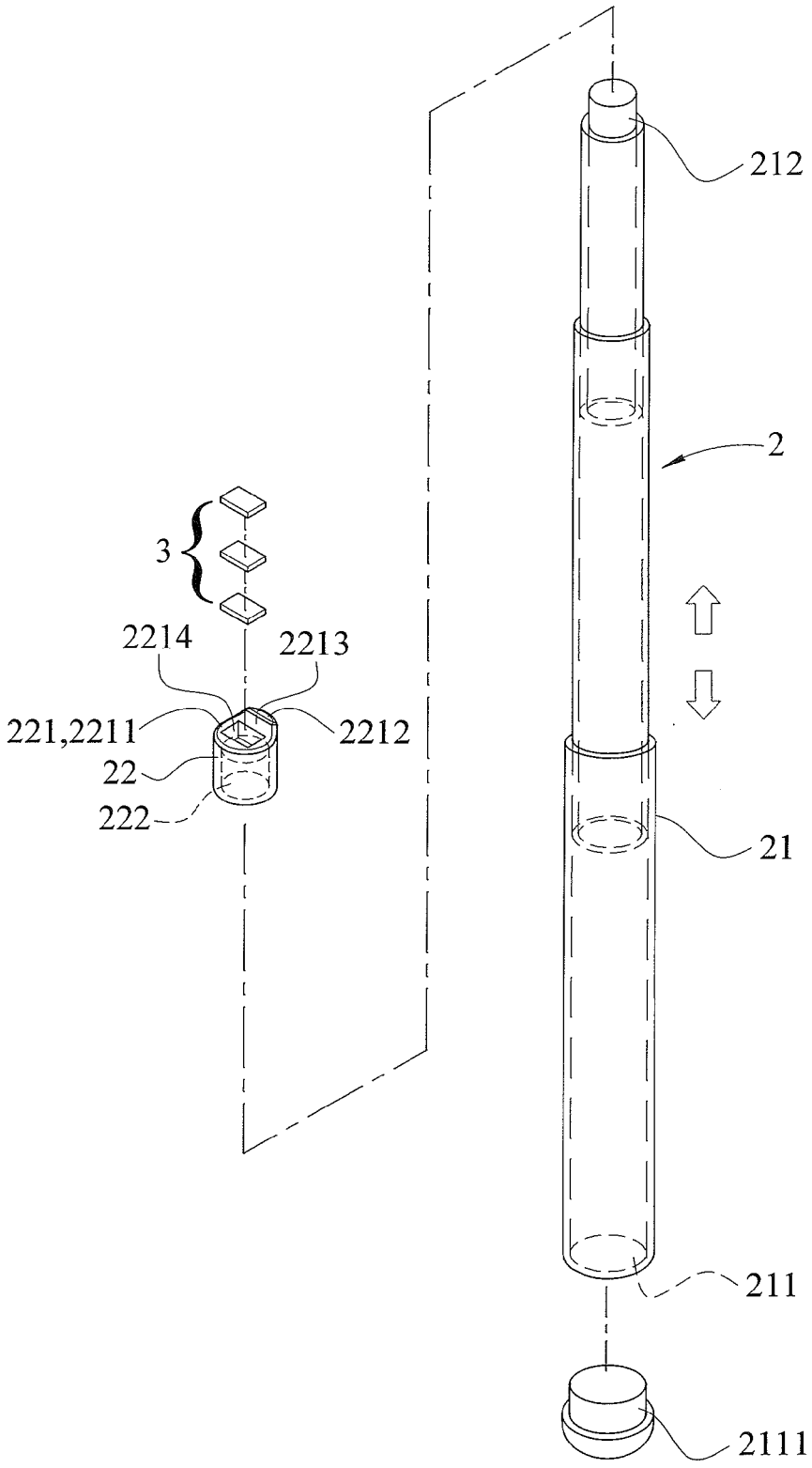
FIG. 5 is an exploded perspective view of the operation handle and the attracting member of the window covering auxiliary device in accordance with another preferred embodiment of the present invention.
Figure 6:
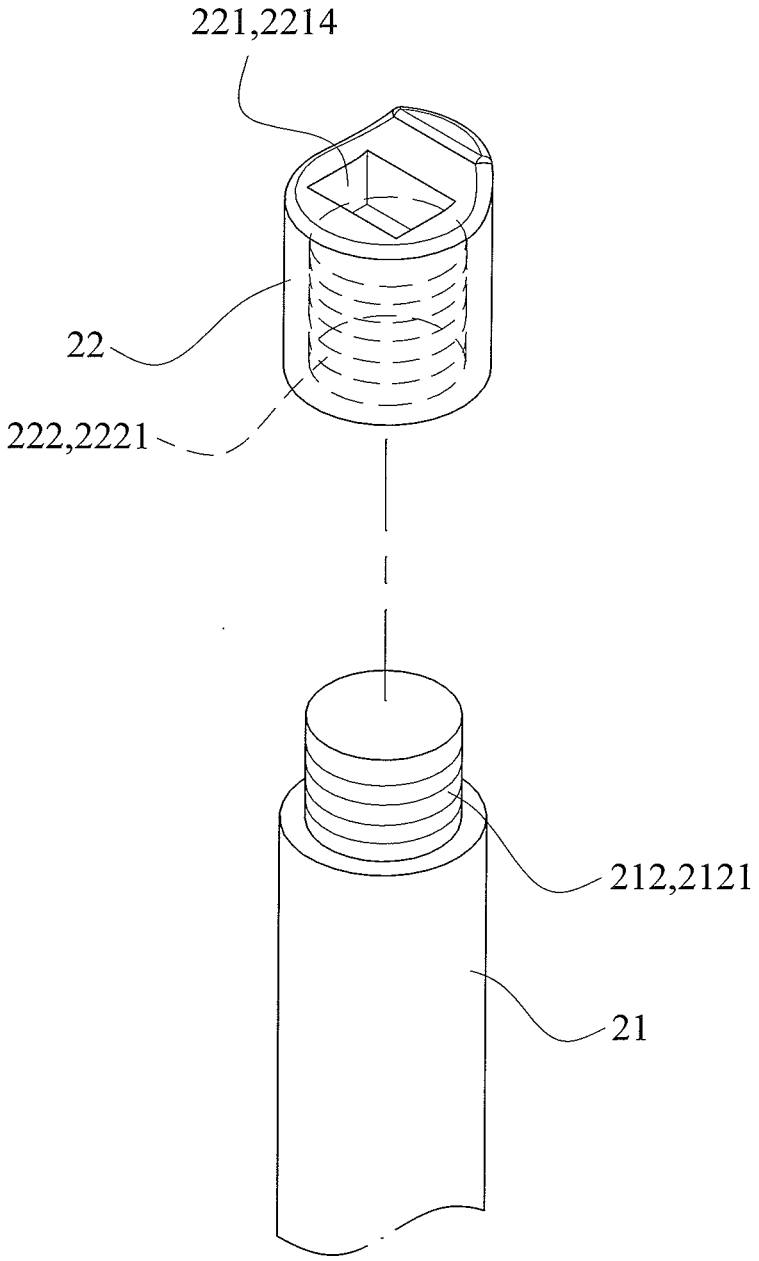
FIG. 6 is a partially exploded perspective view of the operation handle of the window covering auxiliary device in accordance with another preferred embodiment of the present invention.

In the preferred embodiment of the present invention, the holding unit 21 of the operation handle 2 is a pole as shown in FIG. 4 or has a telescopically adjustable structure as shown in FIG. 5. When the holding unit 21 of the operation handle 2 has a telescopically adjustable structure, the holding unit 21 of the operation handle 2 includes a plurality of tubes telescopically connected with each other.

In the preferred embodiment of the present invention, the holding unit 21 and the guiding unit 22 have a combination structure or an integral structure. When the holding unit 21 and the guiding unit 22 have a combination structure, the guiding unit 22 has a bottom provided with a recessed connecting portion 222 which is disconnected from the receiving recess 2214, and the top of the holding unit 21 is provided with a protruding connecting section 212 inserted into the recessed connecting portion 222 of the guiding unit 22, so that the holding unit 21 and the guiding unit 22 are detachably combined with each other as shown in FIGS. 4 and 5. Preferably, the protruding connecting section 212 of the holding unit 21 is provided with an external thread 2121 (see FIG. 6), and the recessed connecting portion 222 of the guiding unit 22 is provided with an internal thread 2221 (see FIG. 6) screwed onto the external thread 2121, so that the recessed connecting portion 222 of the guiding unit 22 is mounted on the protruding connecting section 212 of the holding unit 21.

In operation, the at least one attracted member 1 is mounted on a predetermined position (such as the bottom) of the window covering 4, and the at least one attracting member 3 is mounted on the operation handle 2. In such a manner, when the at least one attracting member 3 is moved by the operation handle 2 to touch the at least one attracted member 1, the at least one attracting member 3 and the at least one attracted member 1 are magnetically attracted with each other, so that the operation handle 2 is operated to move the predetermined position of the window covering 4 (such as to lift or lower the bottom of the window covering 4) so as to fold or expand the window covering 4.

Figure 7:
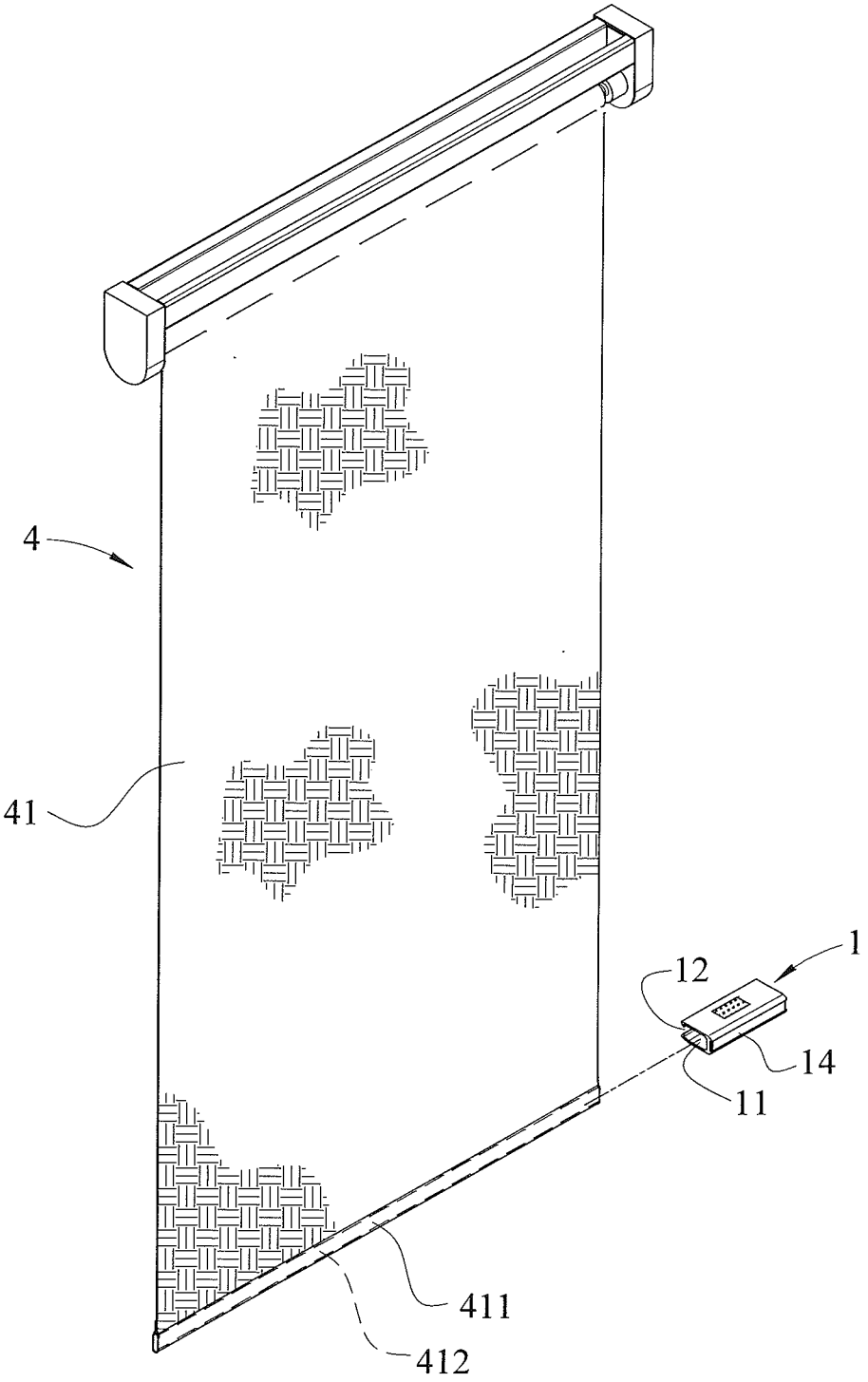
FIG. 7 is a perspective view showing the window covering auxiliary device for a window covering in accordance with the preferred embodiment of the present invention.
Figure 10:
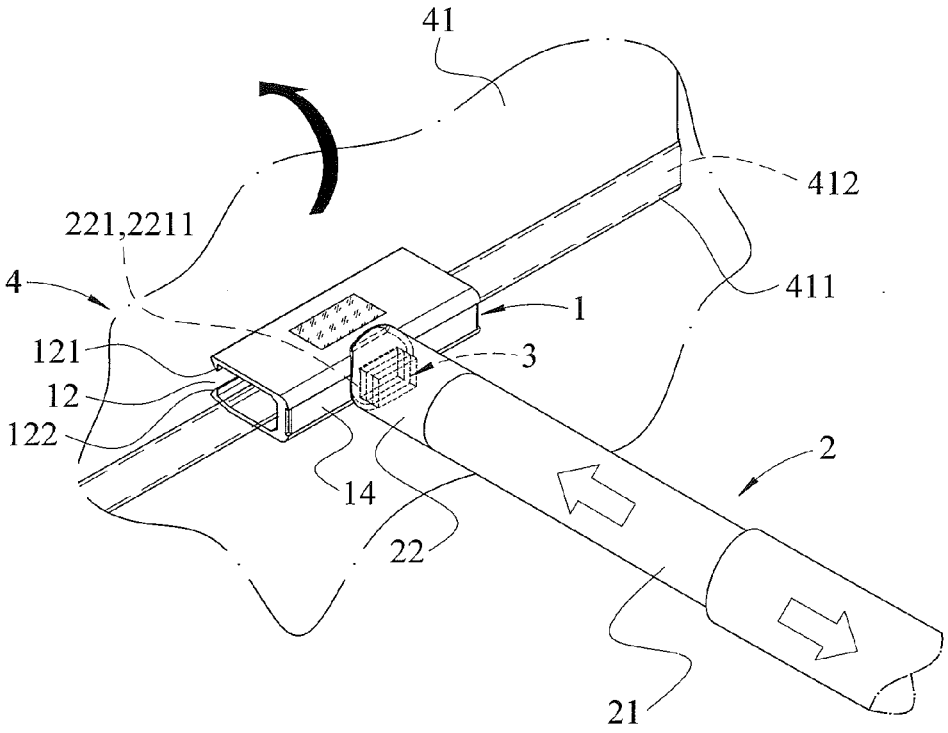
FIG. 10 is a locally enlarged view of the window covering auxiliary device for a window covering as shown in FIGS. 7-9.

In practice, referring to FIGS. 7 and 10 with reference to FIGS. 1-5, the window covering 4 is a roller shade and includes a shading member 41 having a bottom provided with a tubular portion 411, and a weight member 412 mounted in the tubular portion 411 of the shading member 41 as shown in FIG. 7. When the at least one attracted member 1 is mounted on the window covering 4, the tubular portion 411 and the weight member 412 of the window covering 4 are received in the receiving chamber 11 of the at least one attracted member 1 and are clamped and limited by the top hook 121 and the bottom hook 122 of the at least one attracted member 1, so that the at least one attracted member 1 is attached to the shading member 41 of the window covering 4. Thus, when the at least one attracting member 3 is moved by the operation handle 2 to rest on the at least one attracted member 1 as shown in FIG. 10, the magnetic member 14 of the at least one attracted member 1 and the at least one attracting member 3 are magnetically attracted with each other, so that the operation handle 2 is operated by the user to fold or expand the shading member 41 of the window covering 4.

Figure 8:
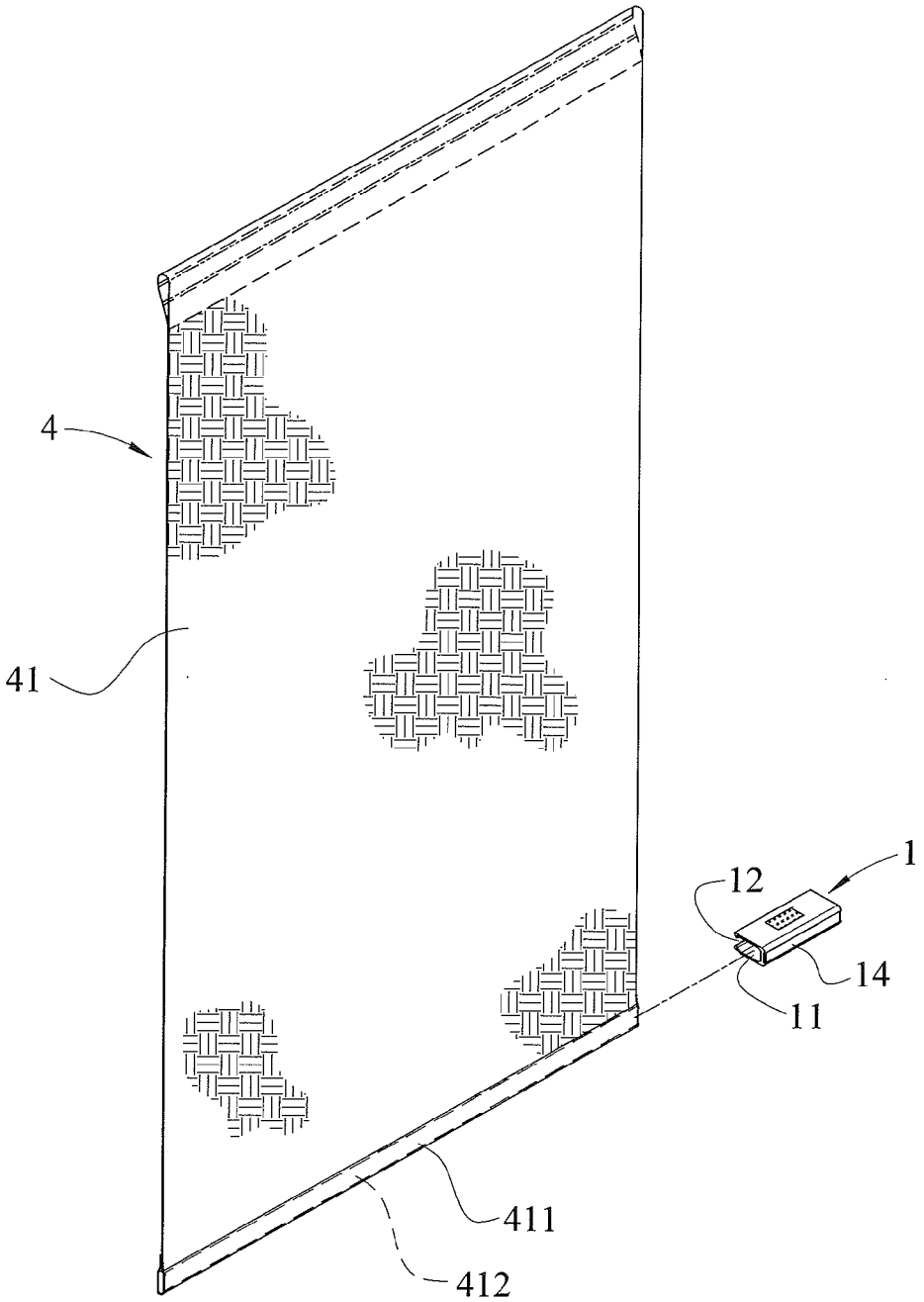
FIG. 8 is a perspective view showing the window covering auxiliary device for a window covering in accordance with another preferred embodiment of the present invention.

As shown in FIG. 8, the window covering 4 is a suspension curtain.

Figure 9:
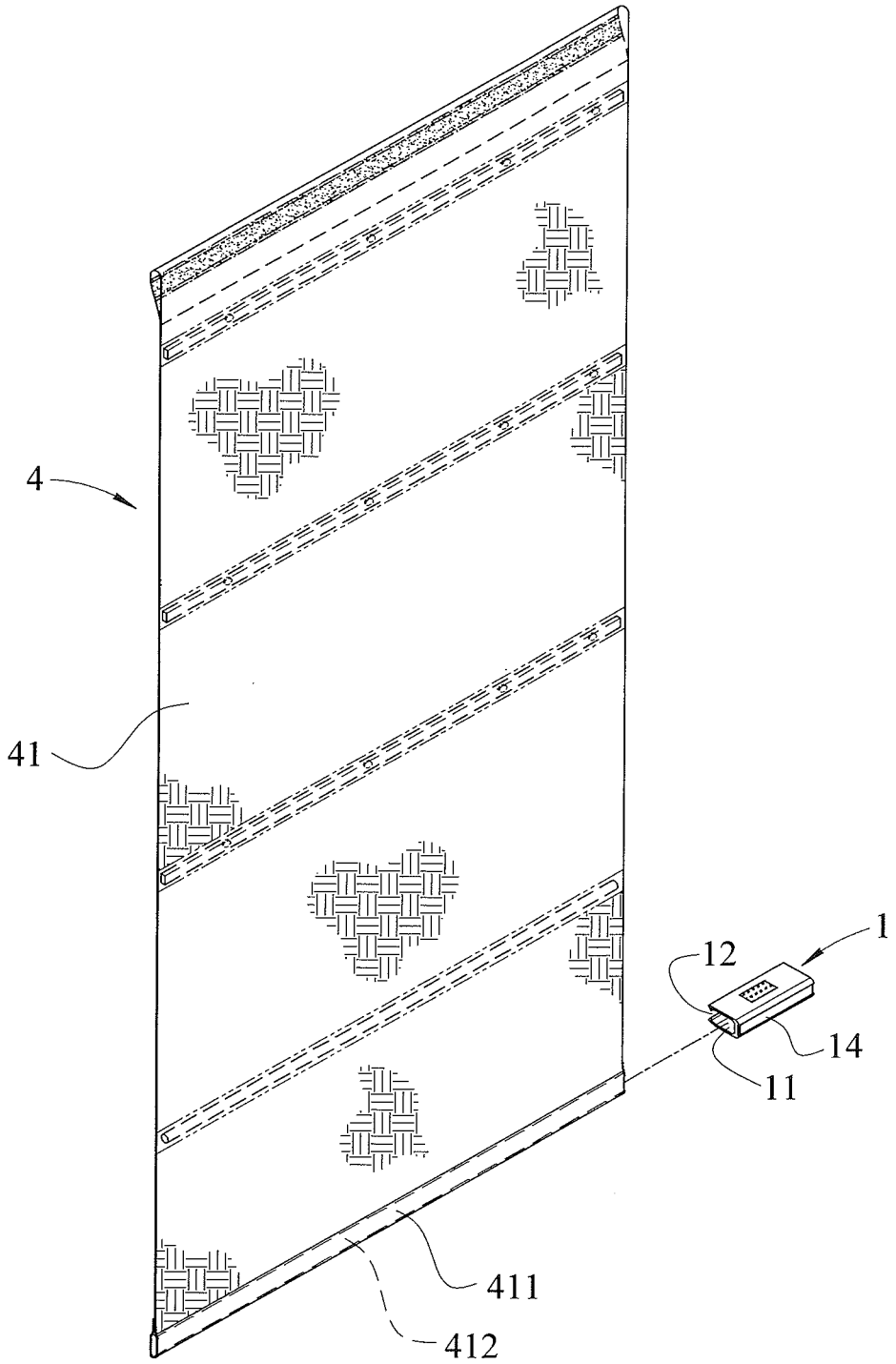
FIG. 9 is a perspective view showing the window covering auxiliary device for a window covering in accordance with another preferred embodiment of the present invention.

As shown in FIG. 9, the window covering 4 is a magnetically attractive shade.

Figure 11:
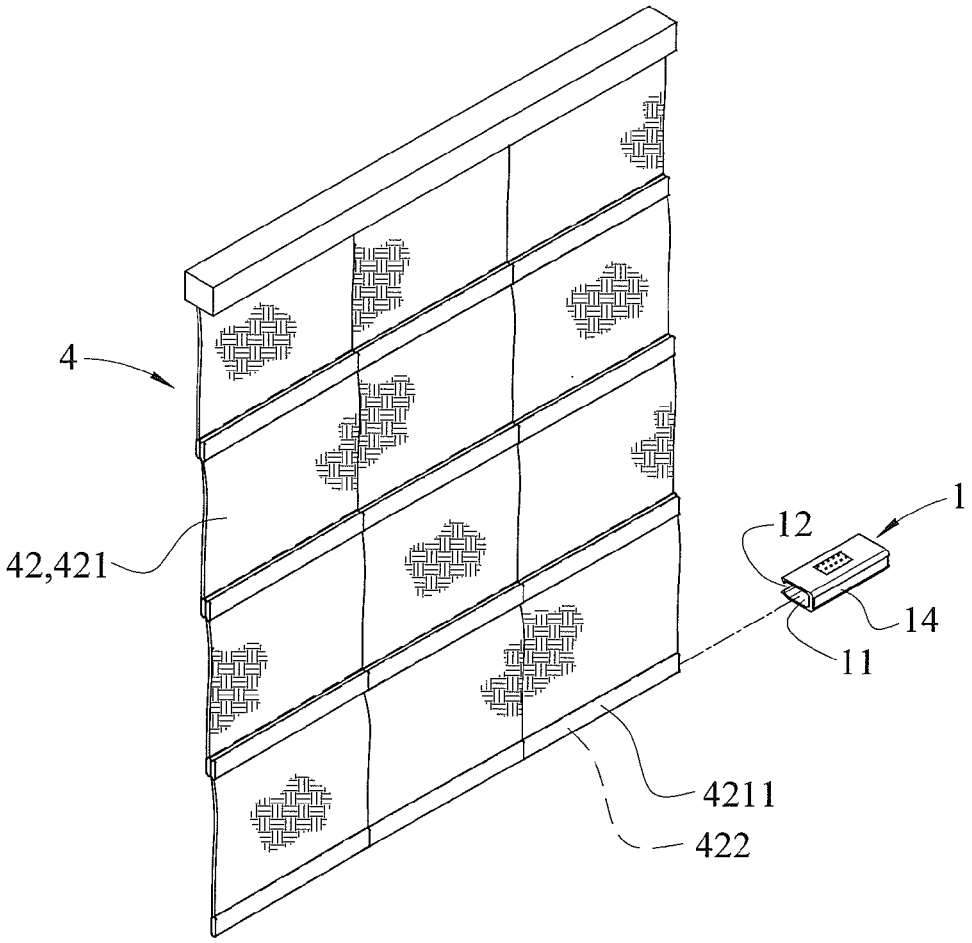
FIG. 11 is a perspective view showing the window covering auxiliary device for a window covering in accordance with another preferred embodiment of the present invention.
Figure 12:
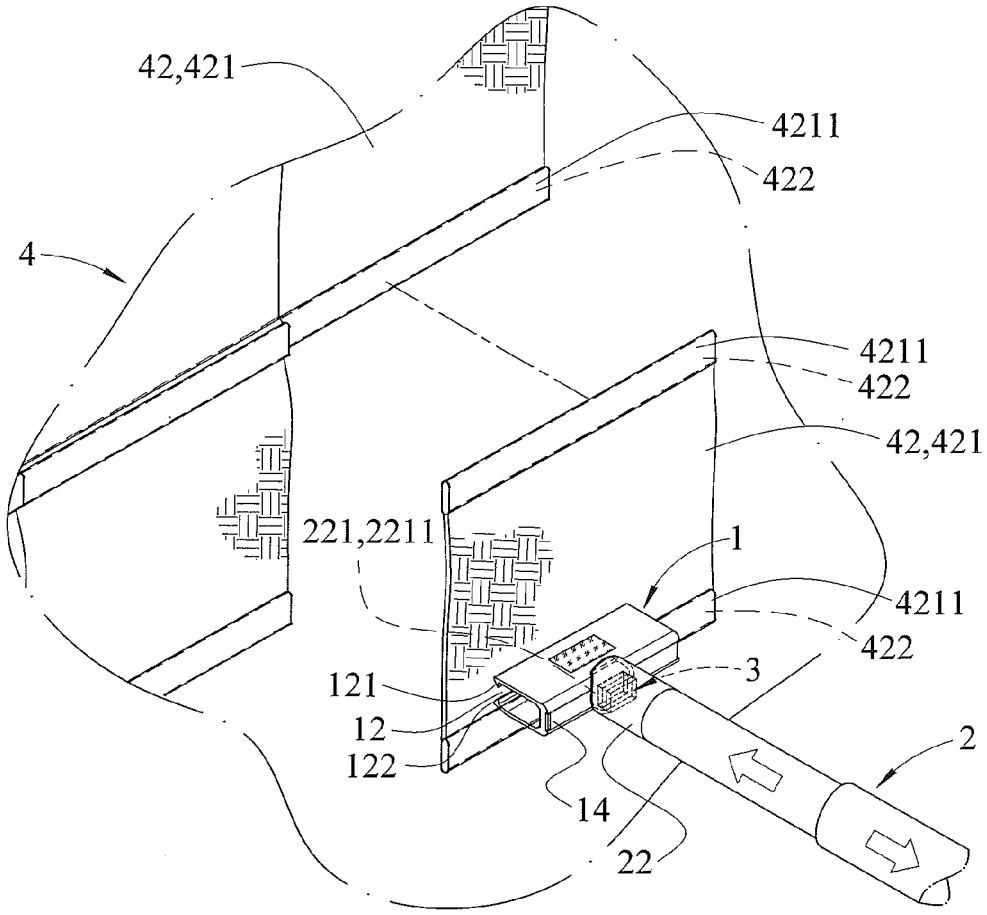
FIG. 12 is a locally enlarged view of the window covering auxiliary device for a window covering as shown in FIG. 11.

Referring to FIGS. 11 and 12, the window covering 4 is a detachable shade and includes a shading member 42 having a plurality of detachable pieces 421 each having two ends each provided with a tubular portion 4211, and a plurality of matching units 422 mounted in the tubular portions 4211 of the detachable pieces 421. When the at least one attracted member 1 is mounted on the window covering 4, the lowermost one of the matching units 422 of the shading member 42 of the window covering 4 is received in the receiving chamber 11 of the at least one attracted member 1 and are clamped and limited by the top hook 121 and the bottom hook 122 of the at least one attracted member 1, so that the at least one attracted member 1 is attached to the shading member 42 of the window covering 4. Thus, when the at least one attracting member 3 is moved by the operation handle 2 to rest on the at least one attracted member 1 as shown in FIG. 12, the magnetic member 14 of the at least one attracted member 1 and the at least one attracting member 3 are magnetically attracted with each other, so that the operation handle 2 is operated by the user to detach one of the detachable pieces 421 of the shading member 42, and move one of the detachable pieces 421 to another one of the detachable pieces 421. In such a manner, the detachable pieces 421 are assembled and disassembled by matching of the matching units 422.

Figure 13:
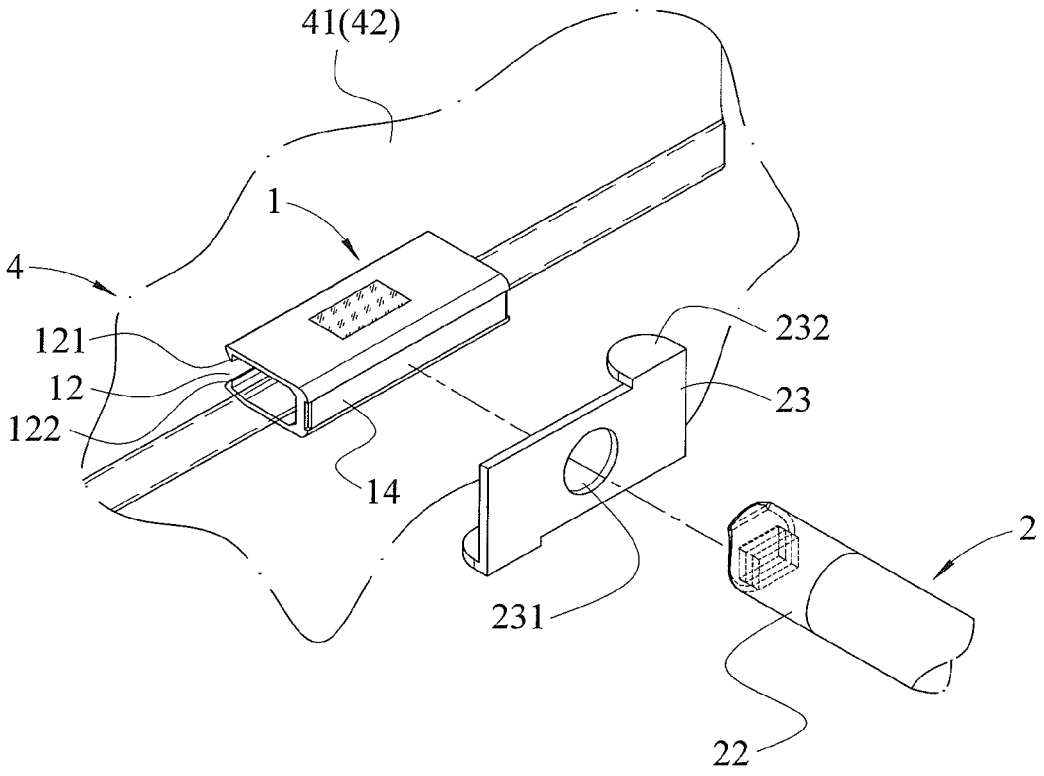
FIG. 13 is a partially exploded perspective view of the window covering auxiliary device for a window covering in accordance with another preferred embodiment of the present invention.
Figure 14:
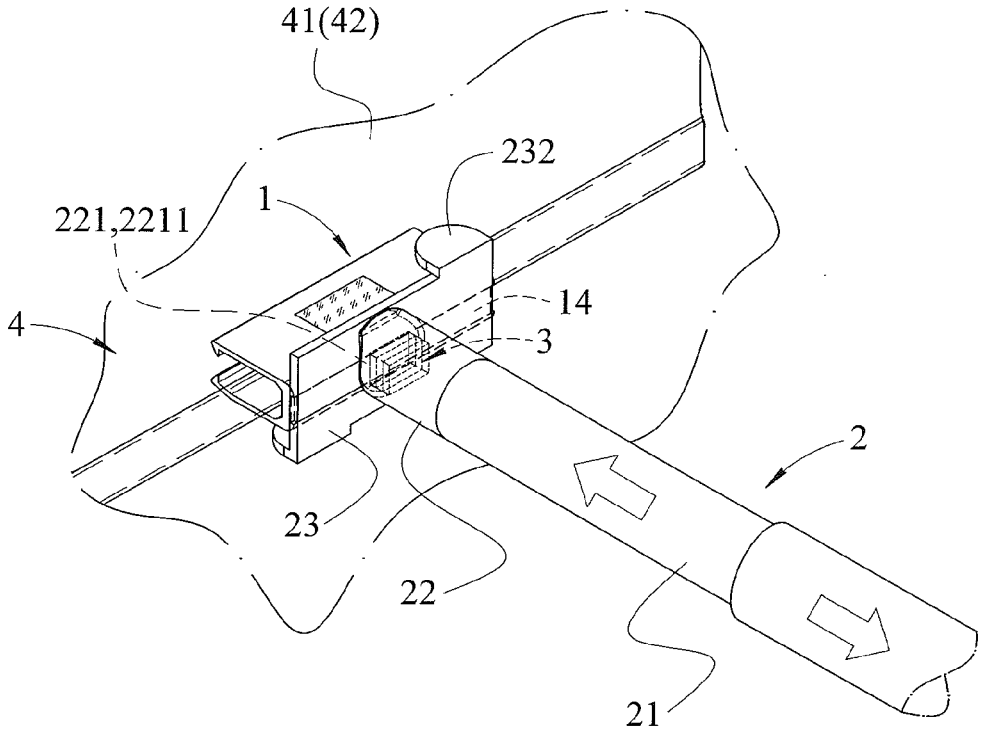
FIG. 14 is a locally enlarged view of the window covering auxiliary device for a window covering as shown in FIG. 13.

Referring to FIGS. 13 and 14, the operation handle 2 further includes a support unit 23 mounted on the top of the guiding unit 22. The support unit 23 is provided with two stop ends 232 formed on two ends thereof. The support unit 23 is provided with a fitting hole 231 mounted on the guiding unit 22. Thus, when the at least one attracting member 3 is moved by the operation handle 2 to rest on the at least one attracted member 1 as shown in FIG. 14, the at least one attracted member 1 is located between the two stop ends 232 of the support unit 23, so that the at least one attracted member 1 is turned by the operation handle 2 stably and conveniently.

In conclusion, the operation handle 2 cooperates with the at least one attracted member 1 to lift or lower the shading member 41 (or the shading member 42) of the window covering 4 to the required position and height so as to fold or expand the shading member 41 (or the shading member 42) of the window covering 4.

Accordingly, the user directly operates the operation handle 2 to lift or lower the shading member 41 (or the shading member 42) of the window covering 4, so that the user can easily adjust the shading member 41 (or the shading member 42) of the window covering 4 to the required position, without restriction of the user's height and age.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A window covering auxiliary device comprising:

at least one attracted member, an operation handle and at least one attracting member;

wherein:

the at least one attracted member is mounted on a window covering;

the operation handle includes a holding unit and a guiding unit;

the guiding unit is mounted on a top of the holding unit and has a top provided with a guide portion;

the guide portion has a substantially L-shaped profile and defines a horizontal section and a vertical section;

the guide portion has an arcuate face formed between the horizontal section and the vertical section;

the horizontal section has a top provided with a receiving recess;

the at least one attracting member is mounted in the receiving recess of the operation handle; and the at least one attracting member and the at least one attracted member are magnetically attracted with each other.

2. The window covering auxiliary device of claim 1, wherein:

the at least one attracted member is made of metallic material;

the at least one attracted member has a substantially U-shaped profile and defines a receiving chamber and a clamping slit;

the clamping slit of the at least one attracted member is provided with a top hook and a bottom hook;

the window covering is clamped by the top hook and the bottom hook of the at least one attracted member;

the at least one attracted member has a face provided with a channel;

a magnetic member is mounted in the channel of the at least one attracted member; and the magnetic member of the at least one attracted member and the at least one attracting member are magnetically attracted with each other.

3. The window covering auxiliary device of claim 1, wherein a marking zone is mounted on the at least one attracted member, and the marking zone is a character, figure, pattern or trademark.

4. The window covering auxiliary device of claim 1, wherein the holding unit of the operation handle is a pole or has a telescopically adjustable structure.

5. The window covering auxiliary device of claim 1, wherein the holding unit and the guiding unit have a combination structure or an integral structure.

6. The window covering auxiliary device of claim 5, wherein when the holding unit and the guiding unit have a combination structure, the guiding unit has a bottom provided with a recessed connecting portion which is disconnected from the receiving recess, and the top of the holding unit is provided with a protruding connecting section inserted into the recessed connecting portion of the guiding unit.

7. The window covering auxiliary device of claim 6, wherein the protruding connecting section of the holding unit is provided with an external thread, and the recessed connecting portion of the guiding unit is provided with an internal thread screwed onto the external thread.

8. The window covering auxiliary device of claim 1, wherein the at least one attracting member is a magnet or an iron block, and the at least one attracting member is secured in the receiving recess of the operation handle by glue.

9. The window covering auxiliary device of claim 1, wherein the holding unit has a bottom provided with an opening, and a plug is inserted into the opening of the operation handle.

10. The window covering auxiliary device of claim 1, wherein the operation handle further includes a support unit mounted on the top of the guiding unit and provided with two stop ends formed on two ends thereof.

* * * * *